US009616980B2

(12) United States Patent
Barr

(10) Patent No.: US 9,616,980 B2
(45) Date of Patent: Apr. 11, 2017

(54) PERSONAL FLOTATION DEVICE

(71) Applicant: Nancy Barr, Middletown, OH (US)

(72) Inventor: Nancy Barr, Middletown, OH (US)

( * ) Notice: Subject to any disclaimer, the term of this patent is extended or adjusted under 35 U.S.C. 154(b) by 126 days.

(21) Appl. No.: 14/018,781

(22) Filed: Sep. 5, 2013

(65) Prior Publication Data

US 2015/0064998 A1 Mar. 5, 2015

(51) Int. Cl.
*B63C 9/11* (2006.01)

(52) U.S. Cl.
CPC ..... *B63C 9/11* (2013.01)

(58) Field of Classification Search
CPC B63C 9/11; B63C 9/115; B63C 9/125; B63C 9/1255
USPC ..... 441/88, 106–119; 2/102, 103; 119/770
See application file for complete search history.

(56) References Cited

U.S. PATENT DOCUMENTS 1,160,252 A * 11/1915 Brokaw ..... B63C 9/115 441/114
2,377,865 A * 6/1945 Coombs ..... B63C 9/115 441/112
2,692,994 A * 11/1954 King ..... B63C 9/115 156/213
D187,312 S * 2/1960 Githens ..... D21/805
3,050,753 A * 8/1962 Baker ..... B63C 9/115 441/115
4,194,257 A * 3/1980 Martin et al. ..... 441/115
4,545,773 A * 10/1985 Evert ..... B63B 35/7993 114/39.18
4,551,108 A * 11/1985 Bass ..... 482/69
4,863,409 A 9/1989 Johnson et al.
5,480,332 A 1/1996 Cynamon
5,514,019 A * 5/1996 Smith ..... 441/88
5,651,711 A * 7/1997 Samano ..... 441/89
5,692,456 A * 12/1997 Louks-Phillips ..... 119/770
5,855,497 A 1/1999 French
5,951,348 A 9/1999 Liong et al.
6,066,017 A * 5/2000 Max et al. ..... 441/98
RE37,394 E 10/2001 Woodyard
6,328,618 B1 * 12/2001 Fleischli ..... 441/106
6,567,992 B2 5/2003 Ross
(Continued)

FOREIGN PATENT DOCUMENTS

JP 2003313707 A * 11/2003

OTHER PUBLICATIONS

Life Jacket Straps—product advertised on http:/www.sailmagazine.com/apparel-accessories/life-jacket-straps. [Retrieved on Sep. 5, 2013].

(Continued)

*Primary Examiner* — Ajay Vasudeva
(74) *Attorney, Agent, or Firm* — Baker & Hostetler LLP

(57) ABSTRACT

This disclosure is generally drawn to systems, devices, apparatuses, and/or methods, related to personal flotation devices (PFDs). Specifically, the disclosed systems, devices, apparatuses, and/or methods relate to PFDs having one or more integrated tethers that may allow a PFD (and its wearer) to be coupled to another PFD (and its wearer) via the integrated tether(s). In some examples, a personal flotation device may include a vest including a buoyant component adapted to float in a body of water, and at least one tether. Each tether may include a first end fixed to the vest and a second end detachably coupled to the vest.

3 Claims, 6 Drawing Sheets

(56) References Cited

U.S. PATENT DOCUMENTS

| | | | | |
|---|---|---|---|---|
| 6,773,318 | B1 * | 8/2004 | Albright | A41D 13/0125 441/118 |
| 6,923,698 | B1 | 8/2005 | Simonson | |
| 7,047,567 | B2 | 5/2006 | Allen | |
| 7,059,925 | B2 | 6/2006 | Smith et al. | |
| 7,255,620 | B1 * | 8/2007 | Shepherd et al. | 441/88 |
| 8,393,929 | B2 | 3/2013 | Laiche | |
| 8,622,263 | B2 * | 1/2014 | Su | 224/153 |
| 9,079,645 | B2 * | 7/2015 | Barbis | B63C 9/11 |
| 2006/0254533 | A1 * | 11/2006 | Fuller et al. | 119/770 |
| 2009/0233504 | A1 * | 9/2009 | Nelson | B63C 9/26 441/80 |
| 2009/0272773 | A1 | 11/2009 | Andrade | |
| 2014/0261236 | A1 * | 9/2014 | Herberth | 119/770 |

OTHER PUBLICATIONS

Pet Emergency Evacuation Jacket—product advertised on http://www.japantrendshop.com/pet-ermegency-jacket-p-694.html. [Retrieved on Sep. 5, 2013].

* cited by examiner

PERSONAL FLOTATION DEVICE

BACKGROUND

Water activities can be very dangerous, as the risk of drowning is ever present. Conventional flotation devices (including personal flotation devices) aim to keep water goers substantially above a water level to minimize the risk of and hopefully avoid drowning However, in the event of several water goers being at higher risk of drowning at in the same area, conventional flotation devices do nothing to keep the water goers near each other. The risk of floating apart or drifting away is great. Attempting to hold one another uses precious energy of the water goers that may be needed for other life-saving activities, such as treading water, swimming, flagging down help, yelling, and the like.

BRIEF DESCRIPTION OF THE DRAWINGS

The foregoing and other features of the present disclosure will become more fully apparent from the following description and appended claims, taken in conjunction with the accompanying drawings. Understanding that these drawings depict several examples in accordance with the disclosure and are, therefore, not to be considered limiting of its scope, the disclosure will be described with additional specificity and detail through use of the accompanying drawings.

In the drawings.

DETAILED DESCRIPTION

Figure 1:
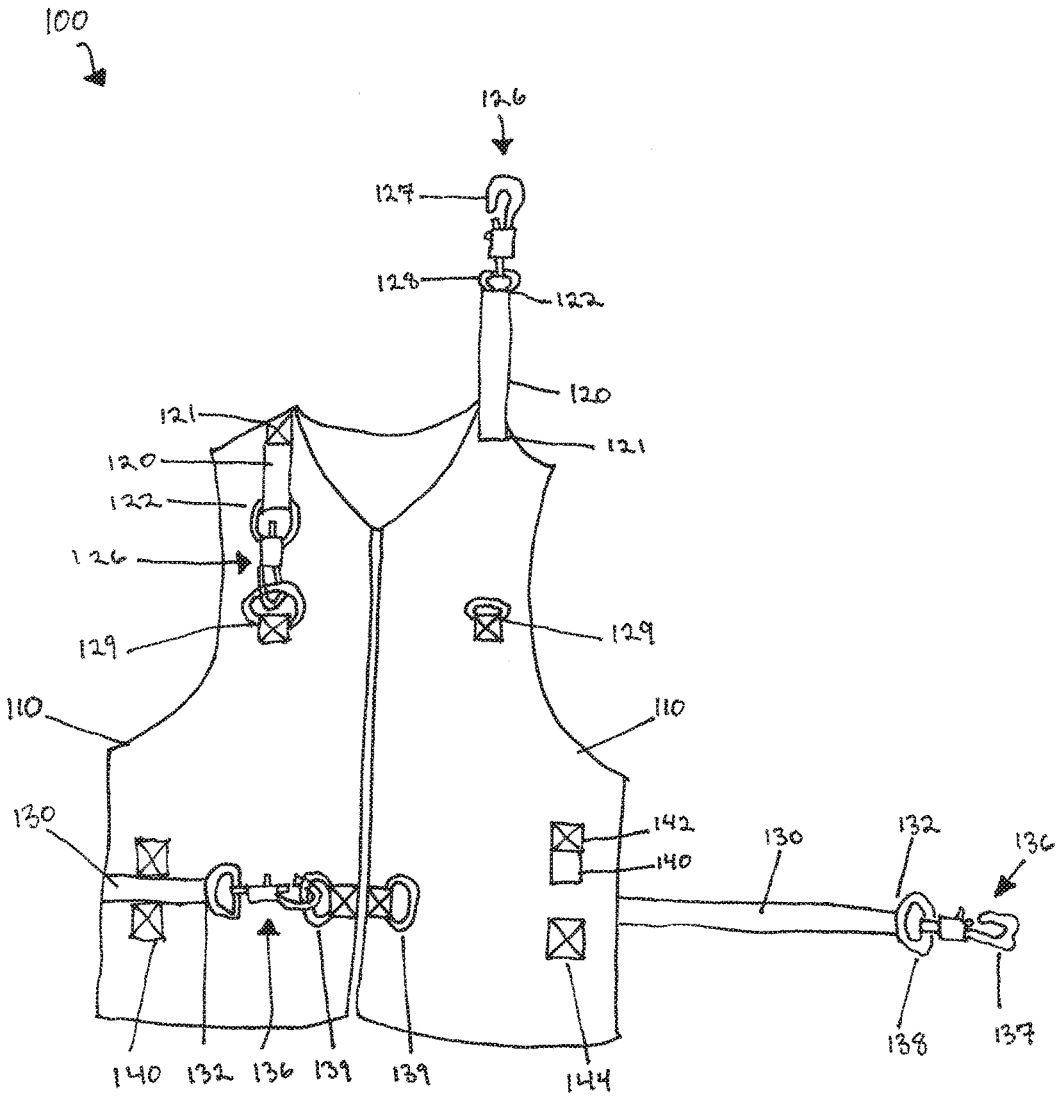
FIG. 1 is a front view of an example personal flotation device.

In the following detailed description, reference is made to the accompanying drawings, which form a part hereof. In the drawings, similar symbols identify similar components, unless context dictates otherwise. The illustrative examples described in the detailed description and drawings are not meant to be limiting and are for explanatory purposes. Other examples may be utilized, and other changes may be made, without departing from the spirit or scope of the subject matter presented herein. It will be readily understood that the aspects of the present disclosure, as generally described herein, and illustrated in the drawings, may be arranged, substituted, combined, and designed in a wide variety of different configurations, each of which are explicitly contemplated and made part of this disclosure.

This disclosure is generally drawn to systems, devices, apparatuses, and/or methods, related to personal flotation devices (PFDs). Specifically, the disclosed systems, devices, apparatuses, and/or methods relate to PFDs having one or more integrated tethers that may allow a PFD (and its wearer) to be coupled to another PFD (and its wearer) via the integrated tether(s).

Figure 2:
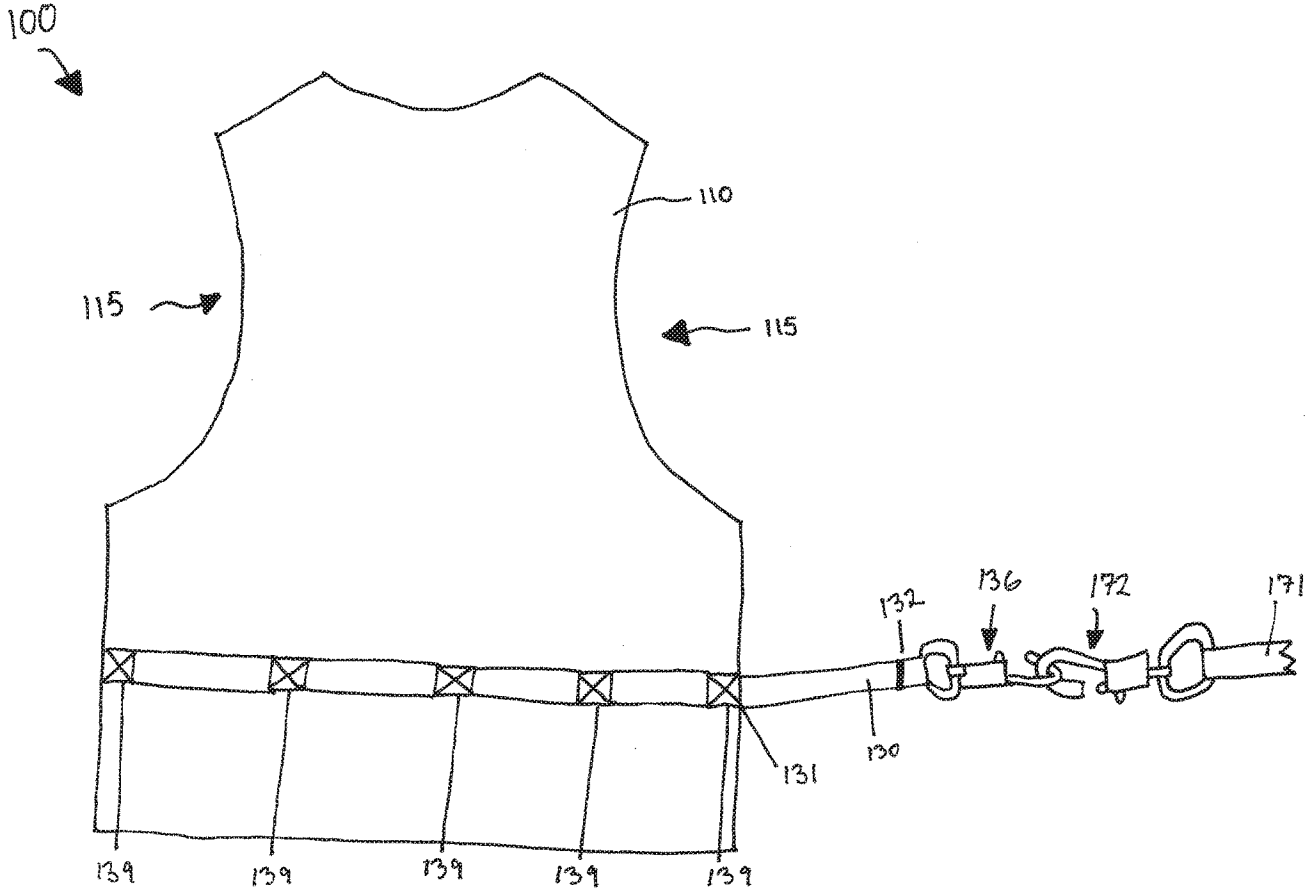
FIG. 2 is a rear view of the example personal flotation device of FIG. 1.

Referring now to FIGS. 1 and 2, front and rear views of an example PFD 100 in accordance with one or more example of the present disclosure are shown, respectively. PFD 100 may include a vest 110 and one or more tether. Each tether may have a first tether end fixed to vest 110 and a second tether end detachably coupled to vest 110. Each tether end fixed to vest 110 may be fixed via stitching, fusing, gluing, and/or other known fixing mechanism and/or technique. Example tethers may be of any suitable fabric such as nylon.

As shown in FIG. 1, some example tether(s) may include shoulder tether(s) 120 and/or waist tether(s) 130. PFD 100 may include one or more retainer 140 that retains shoulder tether(s) 120 and/or waist tether(s).

Shoulder tether 120 may include a first tether end 121 fixed to vest 110 at or near a shoulder portion 111 of vest 110. Shoulder portion 111 may be any area adjacent or near a shoulder of a wearer of PFD 100. Shoulder tether 120 may also include a second tether end 122 that may be detachably coupled to vest 110 at or near a chest portion 112 of vest 110. Chest portion 112 may be any area adjacent or near the chest of a wearer of PFD 100. When second tether end 122 is attached to chest portion 112, shoulder tether 120 rests snugly or loosely against vest 110. When second tether end 122 is detached from chest portion 112, second tether end 122 may move freely in space while shoulder tether 120 remains fixed to vest 110 via first tether end 121. In this manner, second tether end 122 may be detached from vest 110 while shoulder tether 120 remains coupled to and/or integrated with vest 110.

Waist tether 130 may include a first tether end 131 fixed to vest 110 at or near a back waist portion 114 of vest 110. Back waist portion 114 may be any area adjacent or near the back waist of a wearer of PFD 100. Waist tether 130 may also include a second tether end 132 that may be detachably coupled to vest 110 at or near a front waist portion 113 of vest 110. Front waist portion 113 may be any area adjacent or near the front waist of a wearer of PFD 100. When second tether end 132 is attached to front waist portion 113, waist tether 130 rests snugly or loosely against vest 110. When second tether end 132 is detached from front waist portion 113, second tether end 132 may move freely in space while waist tether 130 remains fixed to vest 110 via first tether end 131. In this manner, second tether end 132 may be detached from vest 110 while waist tether 130 remains coupled to and/or integrated with vest 110.

In some examples, waist tether 130 may be fixed to back waist portion 113 at several locations (as shown in FIG. 2). In such examples, second tether end 132 may not terminate at the location where second tether end 132 is fixed to vest 110. As shown in FIG. 2, waist tether 130 may extend around vest 110 such that waist tether 130 extends around the waist of the wearer of PFD 100.

Retainer 140 may retain (either temporarily or permanently) shoulder tether 120 and/or waist tether 130. In this manner, retainer 140 may guide shoulder tether 120 and/or waist tether 130. In some examples, to temporarily retain shoulder tether 120 and/or waist tether 130, retainer 140 may have a first retainer end fixed to vest 110 and a second retainer end detachably coupled to vest 110. For example, retainer 140 may include a hook and loop fastening material 142 that detachably engages a corresponding hook and loop fastening material 144 fixed to vest 110. In some examples, to permanently retain shoulder tether 120 and/or waist tether 130, retainer 140 may have a first retainer end fixed to vest 110 and a second retainer end fixed to vest 110. FIG. 1 depicts retainer temporarily retaining waist tether 130.

Shoulder tether 120 and/or waist tether 130 may have a fastener 126 attached thereto. Specifically, second tether end 122 of shoulder tether 120 may be coupled to fastener 126. Similarly, second tether end 132 of waist tether 130 may be coupled to fastener 136. Fasteners 126, 136 may detachably couple second tether ends 122, 132 to vest 110. Fasteners 126, 136 may be directly coupled to second tether ends 122, 132 and/or may be coupled to second tether ends 122, 132 via connector rings.

While FIGS. 1 and 2 depict hook-type fasteners 126, 136, the present disclosure contemplates that any known fasteners may be used. Some example fasteners may include snap hooks, bolt snaps, swivel snap hooks, spring snaps, caribiners, chain connectors, quick link connectors, trigger snaps, scissor snaps, and/or buckles, among others.

Vest 110 may have a ring 129, 139 attached thereto. Specifically, ring 129, 139 may be coupled to vest 110 to engage fastener 126, 136. In this manner, second tether end 122 of shoulder tether 120 may be coupled to fastener 126, which may be detachably coupled to ring 129, which may be coupled to vest 110. Similarly, second tether end 132 of waist tether 130 may be coupled to fastener 136, which may be detachably coupled to ring 139, which may be coupled to vest 110.

While FIGS. 1 and 2 depict D-rings 129, 139, the present disclosure contemplates that any known rings may be used. Some example rings may include O-rings, oval rings, and/or D-rings, among others.

In some examples, PFD 100 includes at least two arm openings in which a wearer of PFD 100 may insert his or her arms to don vest 110. Similarly, PFD 100 may include at least one top opening in which the wearer's head may extend through when PFD 100 is donned by the wearer. PFD 100 may also include at least one bottom opening in which the wearer's lower body may extend through when PFD 100 is donned by the wearer. In some examples, vest 110 may be a jacket (with or without sleeves), a coat (with or without sleeves), and/or a full-body suit (with or without sleeves). In some examples, the buoyant component may be inflatable and/or inherently buoyant.

Figure 3:
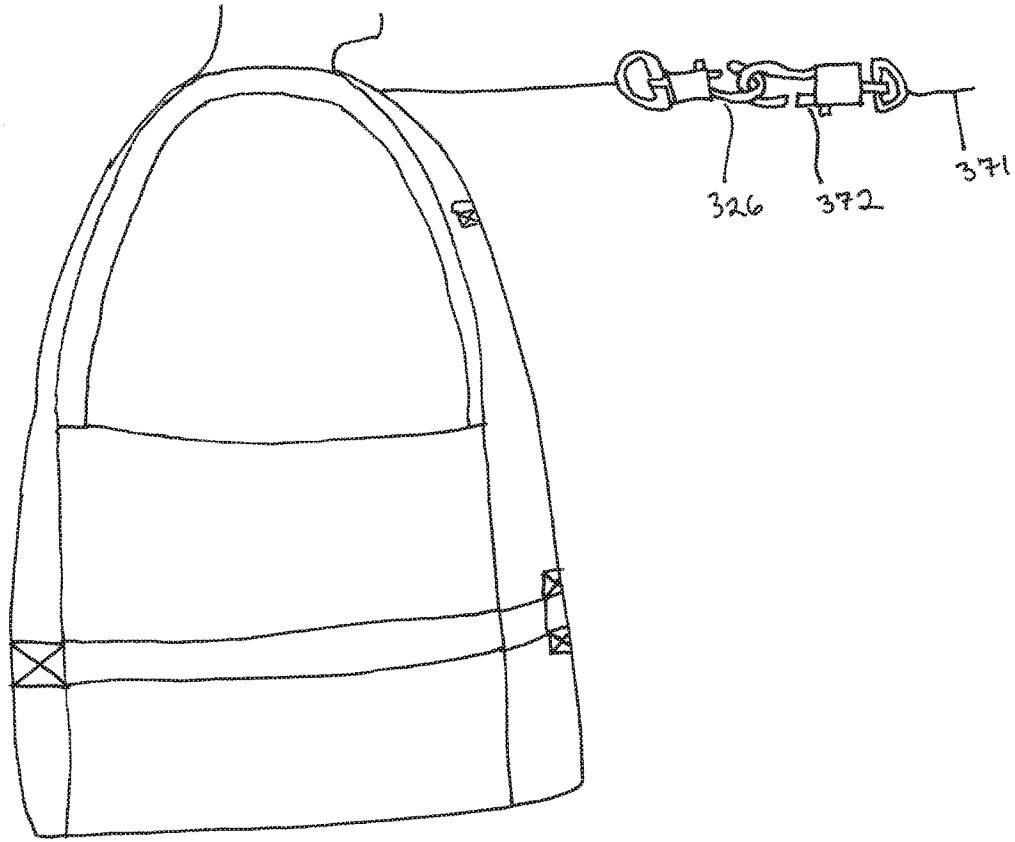
FIG. 3 is a side view of an example personal flotation device coupled to a tether.

Vest 110 may be donned by a wearer. Another wearer may don a similar, same or different type of vest. In some examples, wearer of vest 110 may detach shoulder fastener 126 from vest 110 and couple shoulder fastener 126 to the other wearer's vest, a ring coupled to the other wearer's vest, and/or a fastener coupled to the other wearer's vest. FIG. 3 depicts an example where fastener 326 is coupled to a fastener 372 coupled to a tether 371.

In some examples, wearer of vest 110 may detach waist fastener 136 from vest 110 and couple waist fastener 136 to the other wearer's vest, a ring coupled to the other wearer's vest, and/or a fastener coupled to the other wearer's vest. FIG. 2 depicts an example where waist fastener 136 is coupled to a fastener 172 coupled to a tether 171.

In some examples, a personal flotation device system may be provided. Some example personal flotation device systems may include at least two PFDs. A first PFD may include an integrated tether having a fixed tether section fixed to the first PFD and a detachable section detachably coupled to the first PFD. A second PFD may include an integrated tether having a fixed tether section fixed to the second PFD and a detachable section detachably coupled to the second PFD.

In some examples, first PFD and second PFD may be coupled together. For example, the detachable section of the first PFD may be coupled to the second PFD and/or to the detachable section of the second PFD.

In some example personal flotation device systems, the fixed tether section may be fixed to a waist area of the first PFD. The detachable section of the first PFD may be de-coupled (e.g., unhooked, released, disengaged) from the first PFD and coupled to the waist area of the second PFD, a ring coupled to the second PFD, and/or the detachable section of the second PFD.

FIG. 2 depicts an example where an integrated tether of the first PFD is coupled to a fastener 172 coupled to an integrated tether of the second PFD (not shown). In this example, the wearer of the first PFD and the wearer of the second PFD may be coupled in a waist-to-waist or side-to-side fashion at a distance or in close proximity.

In some examples, the integrated tether may be in a coupled state in which the integrated tether may be restricted from movement or the integrated tether may be in a de-coupled state in which the integrated tether may move freely in space. In the coupled state, the integrated tether of the first PFD may not be coupled to the second PFD. In the de-coupled state, the integrated tether of the first PFD may be coupled to the second PFD.

In some example personal flotation device systems, the fixed tether section may be fixed to a shoulder area of the first PFD. The detachable section of the first PFD may be de-coupled (e.g., unhooked, released, disengaged) from the first PFD and coupled to the waist area of the second PFD, a ring coupled to the second PFD, and/or the detachable section of the second PFD.

Figure 4:
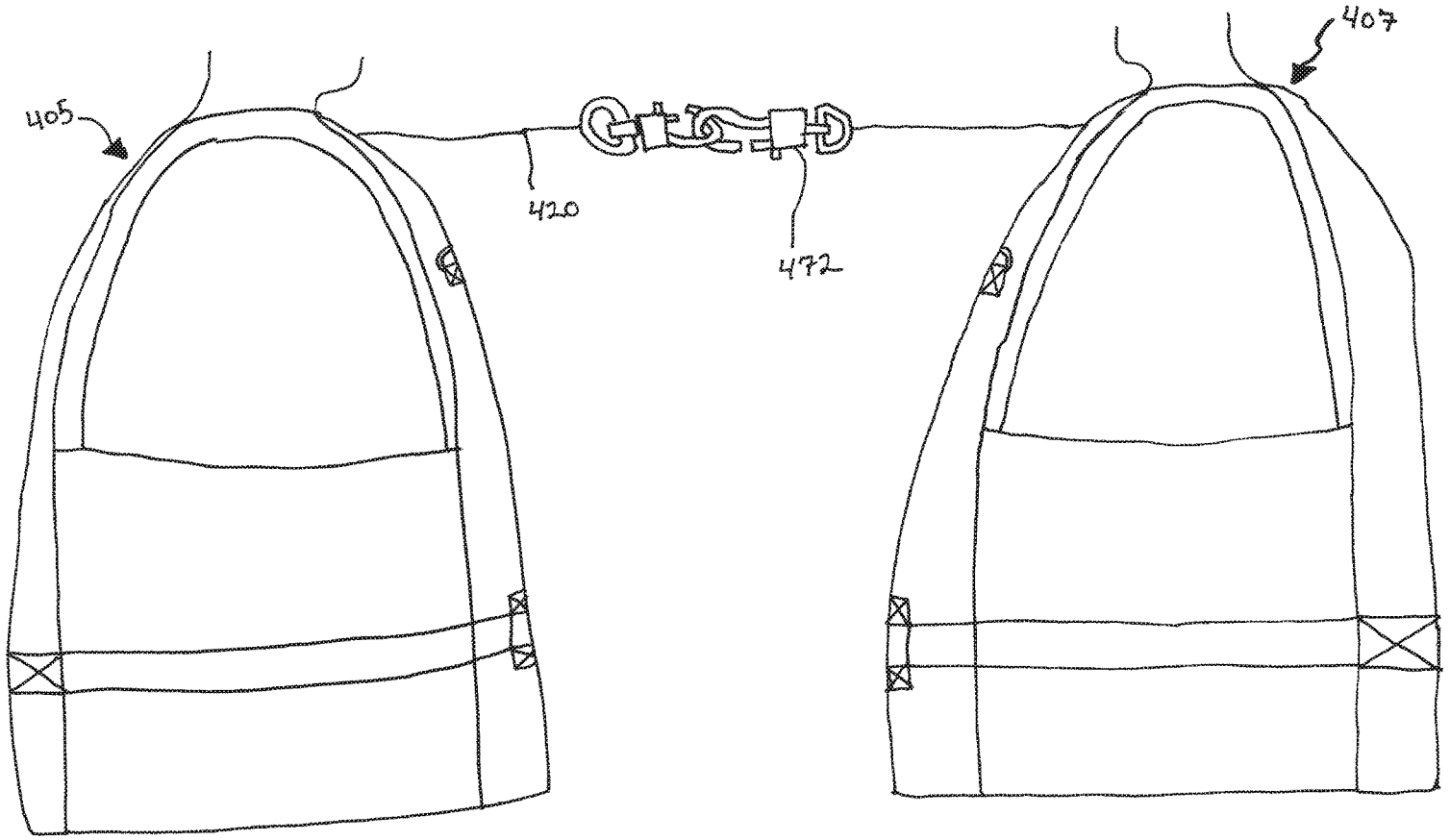
FIG. 4 is a side view of two example personal flotation devices coupled together via respective tethers.
Figure 5:
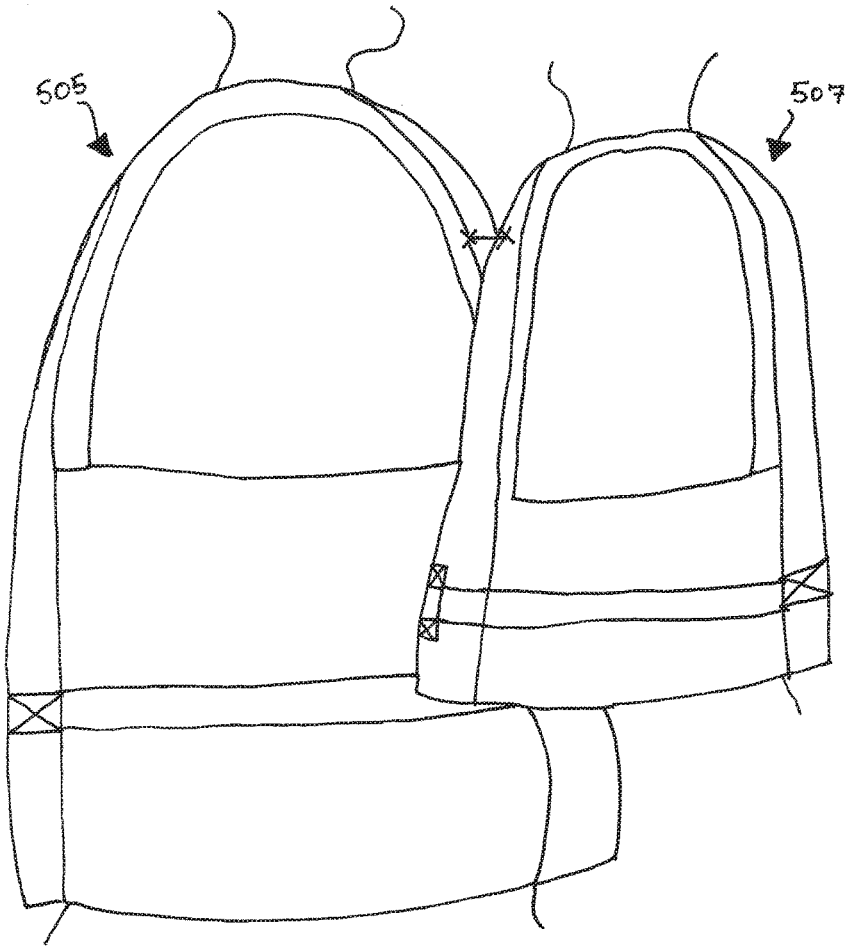
FIG. 5 is a side view of two example personal flotation devices directly coupled together.
Figure 6:
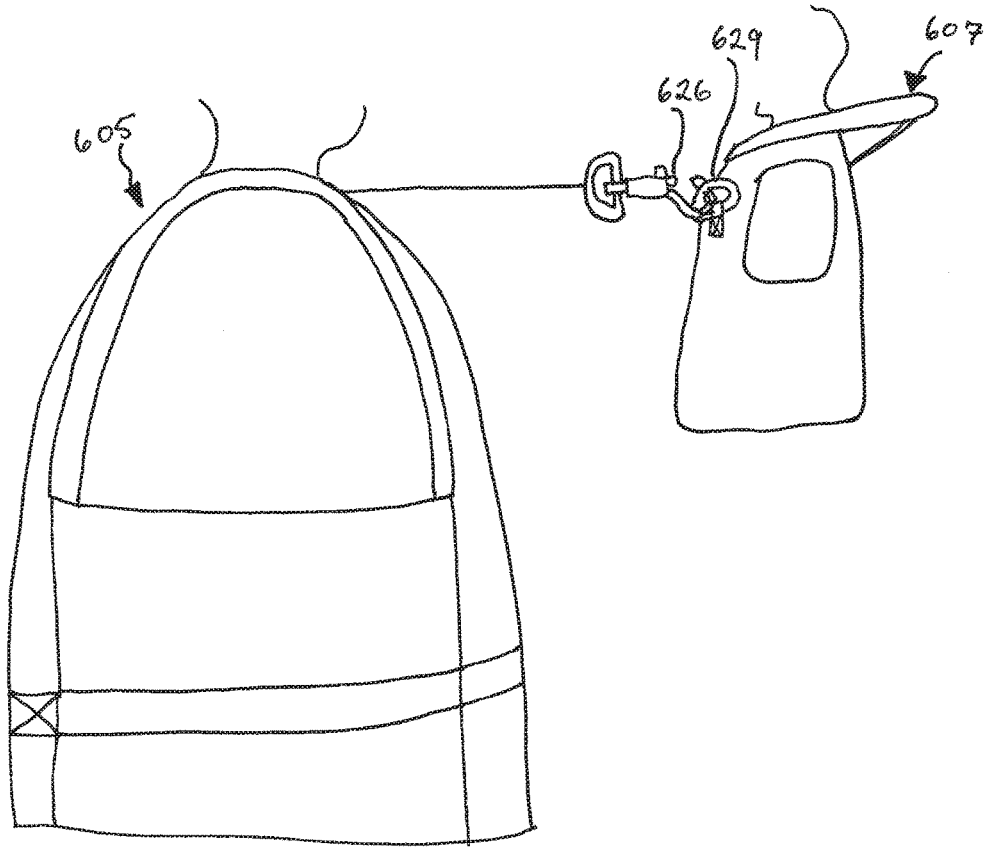
FIG. 6 is a side view of two example personal flotation devices coupled together via tether and a ring; each arranged in accordance with at least an example of the present disclosure.

FIG. 4 depicts an example where an integrated tether 420 of a first PFD 405 is coupled to a fastener 472 coupled to an integrated tether 171 of a second PFD 407. FIG. 5 depicts an example where an integrated tether couples a first PFD 505 directly to a second PFD 507. FIG. 6 depicts an example where an integrated tether of a first PFD 605 is coupled to a ring 629 coupled to a second PFD 607. In these examples, the wearer of the first PFD and the wearer of the second PFD may be coupled in a chest-to-chest or face-to-face fashion at a distance or in close proximity.

In some examples, the integrated tether may be in a coupled state in which the integrated tether may be restricted from movement or the integrated tether may be in a de-coupled state in which the integrated tether may move freely in space. In the coupled state, the integrated tether of the first PFD may not be coupled to the second PFD. In the de-coupled state, the integrated tether of the first PFD may be coupled to the second PFD.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. A personal flotation device, comprising:

a vest comprising a buoyant component adapted to float in a body of water;

a shoulder tether having a shoulder end non-detachably fixed to the vest and a chest end detachably coupled to the vest via a shoulder fastener coupled to the chest end of the shoulder tether, wherein the shoulder fastener detachably couples the chest end to the vest;

a waist tether having a first end and a second end, each of the first end and the second end being detachably coupled to a front of the vest via a waist fastener, the waist tether also having a back portion non-detachably fixed to a back of the vest at a plurality of locations such that the waist tether extends around the vest from the first end to the back portion to the second end; and a retainer adapted to receive the waist tether, the retainer having a first retainer end non-detachably fixed to the vest and a second retainer end detachably coupled to the vest.

2. A personal floatation device, comprising:

a vest comprising a buoyant component adapted to float in a body of water;

a shoulder tether having a shoulder end non-detachably fixed to the vest and a chest end detachably coupled to the vest via a shoulder fastener coupled to the chest end of the shoulder tether, wherein the shoulder fastener detachably couples the chest end to the vest; and a waist tether having a first end and a second end, each of the first end and the second end being detachably coupled to a front of the vest via a waist fastener, the waist tether also having a back portion non-detachably fixed to a back of the vest at a plurality of locations such that the waist tether extends around the vest from the first end to the back portion to the second end;

wherein the vest is donned by a first wearer; and wherein the shoulder fastener is detached from the vest and coupled to at least one of a vest donned by a second wearer, a ring coupled to the vest donned by the second wearer, and a fastener coupled to the vest donned by a second wearer.

3. A personal floatation device, comprising:

a vest comprising a buoyant component adapted to float in a body of water;

a shoulder tether having a shoulder end non-detachably fixed to the vest and a chest end detachably coupled to the vest via a shoulder fastener coupled to the chest end of the shoulder tether, wherein the shoulder fastener detachably couples the chest end to the vest; and a waist tether having a first end and a second end, each of the first end and the second end being detachably coupled to a front of the vest via a waist fastener, the waist tether also having a back portion non-detachably fixed to a back of the vest at a plurality of locations such that the waist tether extends around the vest from the first end to the back portion to the second end;

wherein the vest is donned by a first wearer; and wherein the waist fastener is detached from the vest and coupled to at least one of a vest donned by a second wearer, a ring coupled to the vest donned by the second wearer, and a fastener coupled to the vest donned by a second wearer.

* * * * *